US011145253B2

(12) United States Patent
Kang et al.

(10) Patent No.: US 11,145,253 B2
(45) Date of Patent: Oct. 12, 2021

(54) DISPLAY DEVICE AND METHOD OF DRIVING THE SAME

(71) Applicant: Samsung Display Co., Ltd., Yongin-si (KR)

(72) Inventors: Chul Kyu Kang, Suwon-si (KR); Sang Moo Choi, Yongin-si (KR); Soo Hee Oh, Hwaseong-si (KR); Dongsun Lee, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/506,434

(22) Filed: Jul. 9, 2019

(65) Prior Publication Data

US 2020/0013334 A1 Jan. 9, 2020

(30) Foreign Application Priority Data

Jul. 9, 2018 (KR) ..... 10-2018-0079434

(51) Int. Cl.

| | |
|---|---|
| ***G09G 3/3233*** | (2016.01) |
| ***G09G 3/3258*** | (2016.01) |
| ***G09G 3/3266*** | (2016.01) |
| ***G09G 3/3283*** | (2016.01) |
| ***G09G 3/3291*** | (2016.01) |
| ***G09G 3/36*** | (2006.01) |

(52) U.S. Cl.

CPC ..... *G09G 3/3233* (2013.01); *G09G 3/3258* (2013.01); *G09G 3/3266* (2013.01); *G09G 3/3283* (2013.01); *G09G 3/3291* (2013.01); *G09G 3/3607* (2013.01)

(58) Field of Classification Search

CPC ..... G09G 3/3607; G09G 2310/027; G09G 2310/0275

See application file for complete search history.

(56) References Cited

U.S. PATENT DOCUMENTS

| | | | | |
|---|---|---|---|---|
| 5,861,863 | A * | 1/1999 | Kudo | G09G 3/3692 345/100 |
| 9,805,651 | B2 | 10/2017 | Kim | |
| 2004/0012336 | A1* | 1/2004 | Okuda | G09G 3/3216 315/169.1 |
| 2006/0066252 | A1* | 3/2006 | Kim | G09G 3/3233 315/169.3 |
| 2006/0152459 | A1* | 7/2006 | Shin | G09G 3/20 345/94 |

(Continued)

FOREIGN PATENT DOCUMENTS

KR 10-2015-0144893 12/2015

*Primary Examiner* — Dong Hui Liang

(74) *Attorney, Agent, or Firm* — H.C. Park & Associates, PLC

(57) ABSTRACT

A display device includes a scan driver configured to provide a scan signal to the scan line, the scan signal having an ON voltage for turning on a transistor in a plurality of horizontal periods including a current horizontal period and at least one previous horizontal period corresponding to the scan signal, and a grayscale data processor configured to correct current grayscale data of a current pixel corresponding to the current horizontal period to generate correction grayscale data based on previous grayscale data of a previous pixel corresponding to the previous horizontal period, the current pixel included in a same pixel column as the previous pixel.

18 Claims, 12 Drawing Sheets

(56) References Cited

U.S. PATENT DOCUMENTS

| | | | | |
|---|---|---|---|---|
| 2012/0026141 | A1* | 2/2012 | Pai | G09G 3/344<br>345/208 |
| 2016/0246433 | A1* | 8/2016 | Lee | G09G 3/3659 |
| 2017/0069250 | A1* | 3/2017 | Wang | G09G 3/2074 |

* cited by examiner

FIG. 6A

| | GRAY | ΔG1 |
|---|---|---|
| n-8 | 0 | 0 |
| n-7 | 0 | 0 |
| n-6 | 0 | 0 |
| n-5 | 0 | 0 |
| n-4 | 0 | 0 |
| n-3 | 0 | 0 |
| n-2 | 0 | 0 |
| n-1 | 0 | 0 |
| n | 120 | -3 |

FIG. 6B

| | GRAY | ΔG2 |
|---|---|---|
| n-8 | 0 | 0 |
| n-7 | 0 | 0 |
| n-6 | 0 | 0 |
| n-5 | 0 | 0 |
| n-4 | 0 | 0 |
| n-3 | 0 | 0 |
| n-2 | 0 | 0 |
| n-1 | 0 | 0 |
| n | 120 | -3 |

FIG. 7A

| | GRAY | ΔG1 |
|---|---|---|
| n-8 | 0 | 0 |
| n-7 | 0 | 0 |
| n-6 | 0 | 0 |
| n-5 | 0 | 0 |
| n-4 | 120 | 0 |
| n-3 | 120 | 0 |
| n-2 | 120 | 0 |
| n-1 | 120 | 0 |
| n | 120 | 0 |

FIG. 7B

| | GRAY | ΔG2 |
|---|---|---|
| n-8 | 0 | 0 |
| n-7 | 0 | 0 |
| n-6 | 0 | 0 |
| n-5 | 0 | 0 |
| n-4 | 120 | 0 |
| n-3 | 120 | 0 |
| n-2 | 120 | 0 |
| n-1 | 120 | 0 |
| n | 120 | -3 |

<COMPARATIVE EXEMPLARY EMBODIMENT>

<EXEMPLARY EMBODIMENT>

DISPLAY DEVICE AND METHOD OF DRIVING THE SAME

This application claims priority from and the benefit of Korean Patent Application No. 10-2018-0079434, filed on Jul. 9, 2018, which is hereby incorporated by reference for all purposes as if fully set forth herein.

BACKGROUND

Field

Exemplary embodiments/implementations of the invention relate generally to a display device and a method of driving the display device. and, more specifically, to a display device for improving a display quality and a method of driving the display device.

Discussion of the Background

Recently, various flat panel display devices that have weight and size advantages over conventional display devices such as Cathode Ray Tube (CRT) have been developed. Examples of the flat panel display devices include a liquid crystal display (LCD) device, a field emission display (FED) device, a plasma display panel PDP, and an organic light emitting display OLED device.

The OLED device has advantages such as a rapid response speed and low power consumption because the OLED device uses an organic light emitting diode that emits a light based on recombination of electrons and holes.

The OLED device includes a plurality of pixels and each pixel includes a pixel circuit which includes an organic light emitting diode and a plurality of transistors driving the organic light emitting diode.

The above information disclosed in this Background section is only for understanding of the background of the inventive concepts, and, therefore, it may contain information that does not constitute prior art.

SUMMARY

Exemplary embodiments of the inventive concepts provide an organic light emitting display device for improving a display quality.

Exemplary embodiments of the inventive concepts provide a method of driving the display device.

Additional features of the inventive concepts will be set forth in the description which follows, and in part will be apparent from the description, or may be learned by practice of the inventive concepts.

According to an exemplary embodiment of the inventive concepts, there is provided a display device includes a display panel comprising a pixel which comprises an organic light emitting diode and a plurality of transistors connected to a scan line, a data line and an emission control line and driving the organic light emitting diode, a scan driver configured to provide a scan signal to the scan line, the scan signal having an ON voltage for turning on a transistor in a plurality of horizontal periods including a current horizontal period and at least one previous horizontal period corresponding to the scan signal, a grayscale data processor configured to correct current grayscale data of a current pixel corresponding to the current horizontal period based on previous grayscale data of a previous pixel corresponding to the previous horizontal period, the current pixel included in a same pixel column as the previous pixel, and a data driver configured to convert the grayscale data to a data voltage and to provide the data voltage to the data line.

In an exemplary embodiment, an n-th scan signal (where 'n' is a natural number) may have an scan ON voltage in an n-th horizontal period and at least one (n−k)-th horizontal period (where 'k' is an even number which is equal to or more than 2)

In an exemplary embodiment, the grayscale data processor may include a line memory configured to store grayscale data of pixels included in a plurality of pixel rows, a data comparator configured to compare the at least one previous grayscale data with the current grayscale data, to determine at least one correction value and to calculate a final correction value adding the at least one correction value each other, and a data corrector configured to add the final correction value to the current grayscale data to generate correction grayscale data of the current grayscale data.

In an exemplary embodiment, when the previous grayscale data are black grayscale data and a grayscale difference between the previous grayscale data and the current grayscale data is more than a reference difference, the data comparator may be configured to determine an offset value as the correction value.

In an exemplary embodiment, when first previous grayscale data are black grayscale data and a grayscale difference between the first previous grayscale data and the current grayscale data is more than a first reference difference, the data comparator may be configured to determine a first offset value as a first correction value, and when second previous grayscale data are black grayscale data and a grayscale difference between the second previous grayscale data and the current grayscale data is more than a second reference difference, the data comparator may be configured to determine a second offset value as a second correction value and to add the first correction value to the second correction value to calculate the final correction value.

In an exemplary embodiment, the pixel may include a pixel circuit, the pixel circuit including an organic light emitting diode emitting a light corresponding to a grayscale, a first transistor comprising a first electrode connected to a first node, a second electrode connected to a second node and a third electrode connected to a third node, a capacitor comprising a first electrode receiving a first power source voltage and a second electrode connected to the first node, a second transistor comprising a first electrode connected to an n-th scan signal, a second electrode receiving a data voltage and a third electrode connected to the second node, a third transistor comprising a first electrode receiving the n-th scan signal, a second electrode connected to the first node and a third electrode connected to the third node, and a sixth transistor comprising a first electrode receiving a light-emitting control signal, a second electrode connected to the third node and a third electrode connected to an anode electrode of the organic light emitting diode.

In an exemplary embodiment, the pixel circuit may further include a fourth transistor comprising a first electrode receiving a first gate signal, a second electrode connected to the first node and a third electrode receiving the second power source voltage.

In an exemplary embodiment, the first gate signal is an (n−1)-th scan signal.

In an exemplary embodiment, the pixel circuit may further include a fifth transistor comprising a first electrode receiving the light-emitting control signal, a second electrode receiving the first power source voltage and a third electrode connected to the second node; and a seventh transistor comprising a first electrode receiving the n-th scan signal, a second electrode receiving a second power source voltage and a third electrode connected to an anode electrode of the organic light emitting diode.

According to an exemplary embodiment of the inventive concepts, there is provided a method of driving a display device which includes a pixel which comprises an organic light emitting diode and a plurality of transistors connected to a scan line, a data line and an emission control line and driving the organic light emitting diode, the method including providing a scan signal to the scan line, the scan signal having an ON voltage for turning on a transistor in a plurality of horizontal periods including a current horizontal period and at least one previous horizontal period corresponding to the scan signal, correcting current grayscale data of a current pixel corresponding to the current horizontal period based on previous grayscale data of a previous pixel corresponding to the previous horizontal period, the current pixel included in a same pixel column as the previous pixel, and converting the grayscale data to a data voltage to provide to the data line.

In an exemplary embodiment, an n-th scan signal (where 'n' is a natural number) may have an scan ON voltage in an n-th horizontal period and at least one (n–k)-th horizontal period (where 'k' is an even number which is equal to or more than 2)

In an exemplary embodiment, the method may further include storing grayscale data of pixels included in a plurality of pixel rows, comparing the at least one previous grayscale data with the current grayscale data, to determine at least one correction value and to calculate a final correction value adding the at least one correction value each other, and adding the final correction value to the current grayscale data to generate correction grayscale data of the current grayscale data.

In an exemplary embodiment, the method may further include determining an offset value as the correction value, when the previous grayscale data are black grayscale data and a grayscale difference between the previous grayscale data and the current grayscale data is more than a reference difference.

In an exemplary embodiment, the method may further include determining a first offset value as a first correction value, when first previous grayscale data are black grayscale data and a grayscale difference between the first previous grayscale data and the current grayscale data is more than a first reference difference, determining a second offset value as a second correction value, when second previous grayscale data are black grayscale data and a grayscale difference between the second previous grayscale data and the current grayscale data is more than a second reference difference, and adding the first correction value to the second correction value to calculate the final correction value.

In an exemplary embodiment, the pixel includes a pixel circuit, the pixel circuit including an organic light emitting diode emitting a light corresponding to a grayscale, a first transistor comprising a first electrode connected to a first node, a second electrode connected to a second node and a third electrode connected to a third node, a capacitor comprising a first electrode receiving a first power source voltage and a second electrode connected to the first node, a second transistor comprising a first electrode connected to an n-th scan signal, a second electrode receiving a data voltage and a third electrode connected to the second node, a third transistor comprising a first electrode receiving the n-th scan signal, a second electrode connected to the first node and a third electrode connected to the third node, and a sixth transistor comprising a first electrode receiving a light-emitting control signal, a second electrode connected to the third node and a third electrode connected to an anode electrode of the organic light emitting diode.

In an exemplary embodiment, the pixel circuit may further include a fourth transistor comprising a first electrode receiving a first gate signal, a second electrode connected to the first node and a third electrode receiving the second power source voltage.

According to an exemplary embodiment of the inventive concepts, there is provided a method of driving a display device which includes a pixel which comprises an organic light emitting diode and a plurality of transistors connected to a scan line, a data line and an emission control line and driving the organic light emitting diode, the method including determining whether a image signal is a image signal of an odd numbered frame or an even numbered frame, providing a scan signal to the scan line, the scan signal having an ON voltage for turning on a transistor in a plurality of horizontal periods including a current horizontal period and at least one previous horizontal period corresponding to the scan signal, correcting current grayscale data of a current pixel corresponding to the current horizontal period based on previous grayscale data of a previous pixel corresponding to the previous horizontal period, the current pixel included in a same pixel column as the previous pixel when the image signal is the image signal of the odd numbered frame and converting the grayscale data of the odd numbered frame to a data voltage to provide to the data line.

In an exemplary embodiment, the method may further include when the image signal is the image signal of the odd numbered frame, providing a scan signal to the scan line, the scan signal having an ON voltage for turning on a transistor in a plurality of horizontal periods including a current horizontal period and at least one previous horizontal period corresponding to the scan signal and converting the grayscale data of the even numbered frame to a data voltage to provide to the data line.

According to an exemplary embodiment of the inventive concepts, there is provided a method of driving a display device which includes a pixel which comprises an organic light emitting diode and a plurality of transistors connected to a scan line, a data line and an emission control line and driving the organic light emitting diode, the method including determining whether a image signal is a static image signal or a dynamic image signal, providing a scan signal to the scan line, the scan signal having an ON voltage for turning on a transistor in a plurality of horizontal periods including a current horizontal period and at least one previous horizontal period corresponding to the scan signal, correcting current grayscale data of a current pixel corresponding to the current horizontal period based on previous grayscale data of a previous pixel corresponding to the previous horizontal period, the current pixel included in a same pixel column as the previous pixel when the image signal is the static image signal, and converting the grayscale data of the static image signal to a data voltage to provide to the data line.

In an exemplary embodiment, the method may further include when the image signal is dynamic image signal, providing a scan signal to the scan line, the scan signal having an ON voltage for turning on a transistor in a plurality of horizontal periods including a current horizontal period and at least one previous horizontal period corresponding to the scan signal, and converting the grayscale data of the dynamic image signal to a data voltage to provide to the data line.

According to the inventive concepts, in the display device applying the MC clk mode, the grayscale data of the current pixel is corrected based on the previous pixel data of at least one previous pixel in the same pixel column as the current pixel and thus, display defects such as the text ghost may be eliminated.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

FIGS. 6A and 6B are conceptual diagrams illustrating a method of correcting a grayscale data according to one exemplary embodiment;

FIGS. 7A and 7B are conceptual diagrams illustrating a method of correcting a grayscale data according to one exemplary embodiment;

DETAILED DESCRIPTION

Figure 1:
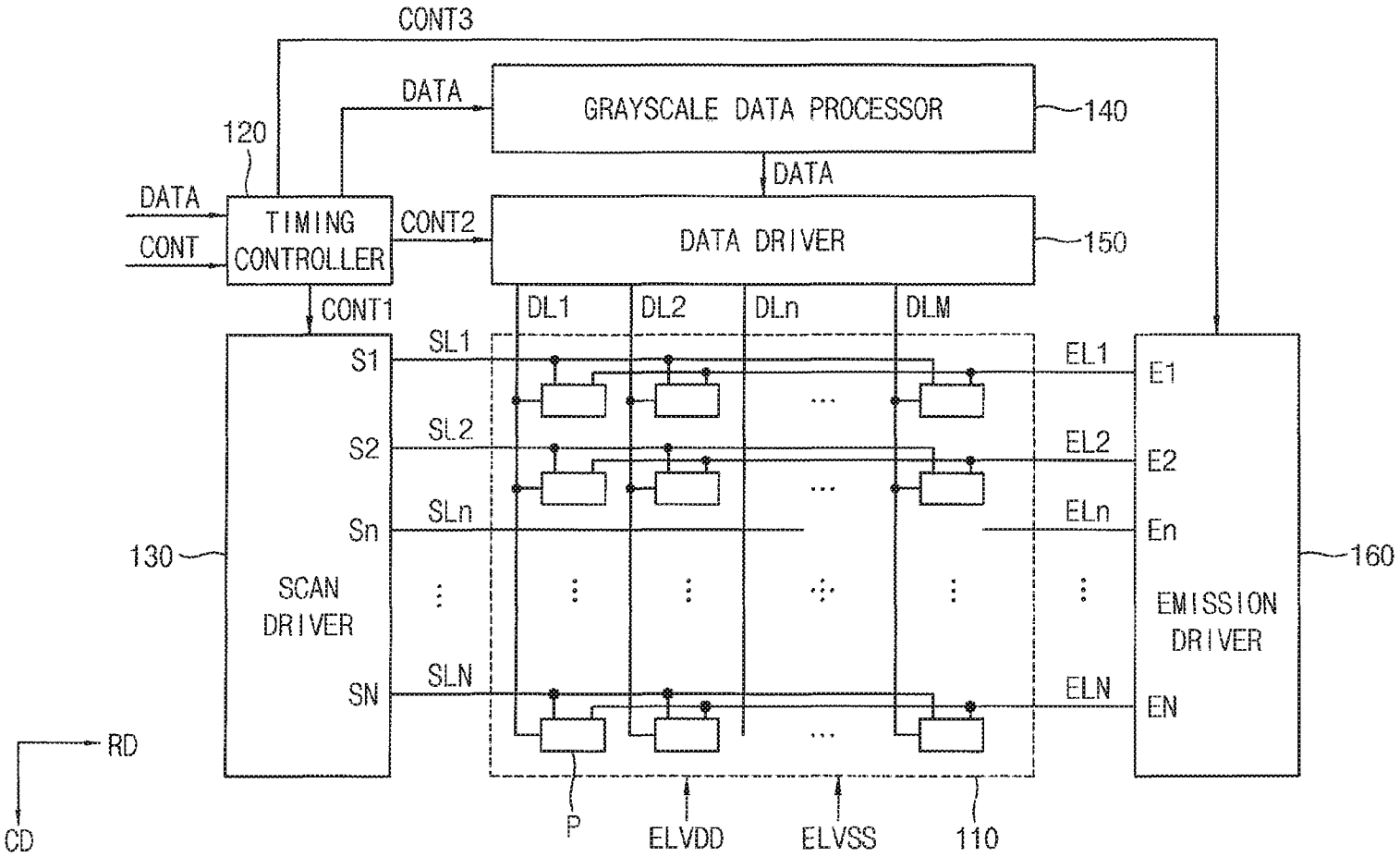
FIG. 1 is a block diagram illustrating a display device according to one exemplary embodiment.

In the following description, for the purposes of explanation, numerous specific details are set forth in order to provide a thorough understanding of various exemplary embodiments or implementations of the invention. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the row direction RD-axis and the column direction CR-axis are not limited to a rectangular coordinate system, such as the x, y, and z-axes, and may be interpreted in a broader sense. For example, the RD-axis and the CD-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As customary in the field, some exemplary embodiments are described and illustrated in the accompanying drawings in terms of functional blocks, units, and/or modules such as processors or drivers. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some exemplary embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

FIG. 1 is a block diagram illustrating a display device according to one exemplary embodiment.

Referring to FIG. 1, the display device 100 may include a display panel 110, a timing controller 120, a scan driver 130, a grayscale data processor 140, a data driver 150 and an emission driver 160.

The display panel 110 may include a plurality of pixels P, a plurality of scan lines SL1, . . . , SLn, . . . , SLN, a plurality of data lines DL1, . . . , DLm, . . . , DM and a plurality of emission control lines EL1, . . . , ELn, . . . , ELN (where 'n', 'N', 'm' and 'M' are natural numbers).

The pixels P may be arranged as a matrix type which includes a plurality of pixel rows and a plurality of pixel columns. The pixel row corresponds to a horizontal line and the pixel column corresponds to a vertical line.

Each pixel P includes a pixel circuit, and the pixel circuit includes a plurality of transistors connected to a scan line, a data line, and an emission control line, and an organic light emitting diode driven by the plurality of transistors.

The data lines DL1, . . . , DLm, . . . , DLM may extend in a column direction CD and be arranged in a row direction RD. The data lines DL1, . . . , DLm, . . . , DLM are connected to the data driver 150 and transfer data voltages to the pixels P.

The scan lines SL1, . . . , SLn, . . . , SLN may extend in the row direction RD, and be arranged in the column direction CD. The scan lines SL1, . . . , SLn, . . . , SLN are connected to the scan driver 130 and transfer scan signals the pixels P.

The emission control lines EL1, . . . , ELn, . . . , ELN may extend in the row direction RD, and be arranged in the column direction CD. The emission control lines EL1, . . . , ELn, . . . , ELN are connected to the emission driver 160 and transfer emission control signals to the pixels P.

In addition, the pixels P may receive a first power source voltage ELVDD and a second power source voltage ELVSS.

Each of the pixels P may receive a data voltage in response to the scan signal, and emit a light corresponding to the data voltage using the first and second power source voltages ELVDD and ELVSS.

The timing controller 120 may receive an image signal DATA and a control signal CONT from an external device. The image signal DATA may include red, green and blue data. The control signal CONT may include a horizontal synchronization signal Hsync, a horizontal synchronization signal Vsync, a main clock signal MCLK, etc.

The timing controller 120 may convert the image signal DATA to image data corresponding to a pixel structure and a resolution of the display panel 110 and provides the image data to the grayscale data processor 140.

The timing controller 120 may generate a first control signal CONT1 for driving the scan driver 130, a second control signal CONT2 for driving the data driver 150 and a third control signal CONT3 for driving the emission driver 160 based on the control signal CONT.

The scan driver 130 may generate a plurality of scan signals S1, . . . , Sn, . . . , SN in response to the first control signal CONT1. Each of the plurality of scan signals S1, . . . , Sn, . . . , SN has a scan ON voltage for turning on a transistor in the pixel P in q horizontal periods among the frame according to an MC (Motion Clarity) q-clk mode (where 'q' is a natural number that is equal to or more than 2), as explained further below. The MC q-clk mode is a driving mode for improving luminance characteristics of motion. For example, in an MC 3-clk mode, the scan driver generates a scan signal having a scan ON voltage in a self-horizontal period and 2 previous horizontal periods which are before the self-horizontal period and a scan OFF voltage in remaining horizontal periods. Therefore, the luminance characteristic of the pixel may be improved by applying the data of the previous horizontal periods before the data of the pixel is applied to the self horizontal period.

Generally, characteristics of the transistor driving an organic light emitting diode (OLED) differ between when the organic light emitting diode displays a white grayscale and a black grayscale. Thus, when a black grayscale changes to the white grayscale, a luminance changes do not occur immediately, but rather occurs gradually over a plurality of frames. A luminance ratio of displaying the white grayscale in a first frame among the plurality of frames to displaying full white grayscale after the plurality of frames is called a step efficiency (S/E). The S/E decreases based upon the hysteresis characteristics of the transistor. To compensate for decreasing the S/E, the scan signal of the MC q-clk mode is applied to the transistor in the pixel. The scan signal of the MC q-clk mode may have a scan ON voltage in q horizontal periods which includes a current horizontal period and at least one previous horizontal period.

According to an exemplary embodiment, the scan driver 130 may be configured to a scan signal having a scan ON voltage in 3 horizontal periods of the frame period according to an MC 3-clk mode. The scan signal according to the MC 3-clk mode may have the scan ON voltage in an n-th horizontal period Hn that is a current horizontal period and 2 previous horizontal periods that are (n−k)-th horizontal period Hn−k (where k is an even number which is equal to or more than 2).

For example, the n-th scan signal Sn may have the scan ON voltage in an n-th horizontal period Hn, an (n−2)-th horizontal period Hn−2 and an (n−4)-th horizontal period Hn−4. Alternatively, the n-th scan signal Sn may have the scan ON voltage in an n-th horizontal period Hn, an (n−4)-th horizontal period Hn−4 and an (n−8)-th horizontal period Hn−8. The MC q-clk mode may be predetermined variously according to various driving modes.

The grayscale data processor 140 is configured to correct grayscale data of the pixel to improve display defects by the scan signal of the MC q-clk mode generated from the scan driver 130.

The pixel receives a previous data voltage by the scan signal of the MC q-clk mode which has the scan ON voltage in the previous horizontal period and thus the pixel does not display a target luminance by changed on-bias voltage.

The grayscale data processor 140 is configured to correct grayscale data of a current pixel based on grayscale data of the current pixel and at least one previous pixel in a same pixel column as the current pixel.

For example, when the scan driver 130 generates a scan signal of an MC 3-clk mode, the grayscale data of the current pixel may be corrected using the grayscale data of 2 previous pixels in a same pixel column as the current pixel. Thus, the current pixel may display a target luminance.

The data driver 150 is configured to convert the grayscale data DATA provided from the grayscale data processor 140 to a data voltage in response to the first control signal CONT1 and to output the data voltage to the data lines DL1, . . . , DLm, . . . , DLM.

The emission driver 160 is configured to generate a plurality of light-emitting control signals in response to the third control signal CONT3. The emission driver 160 is configured to simultaneously or sequentially output a plurality of light-emitting control signals E1, . . . , En, . . . , EN to the emission control lines EL1, . . . , ELn, . . . , ELN based on the third control signal CONT3.

Figure 2:
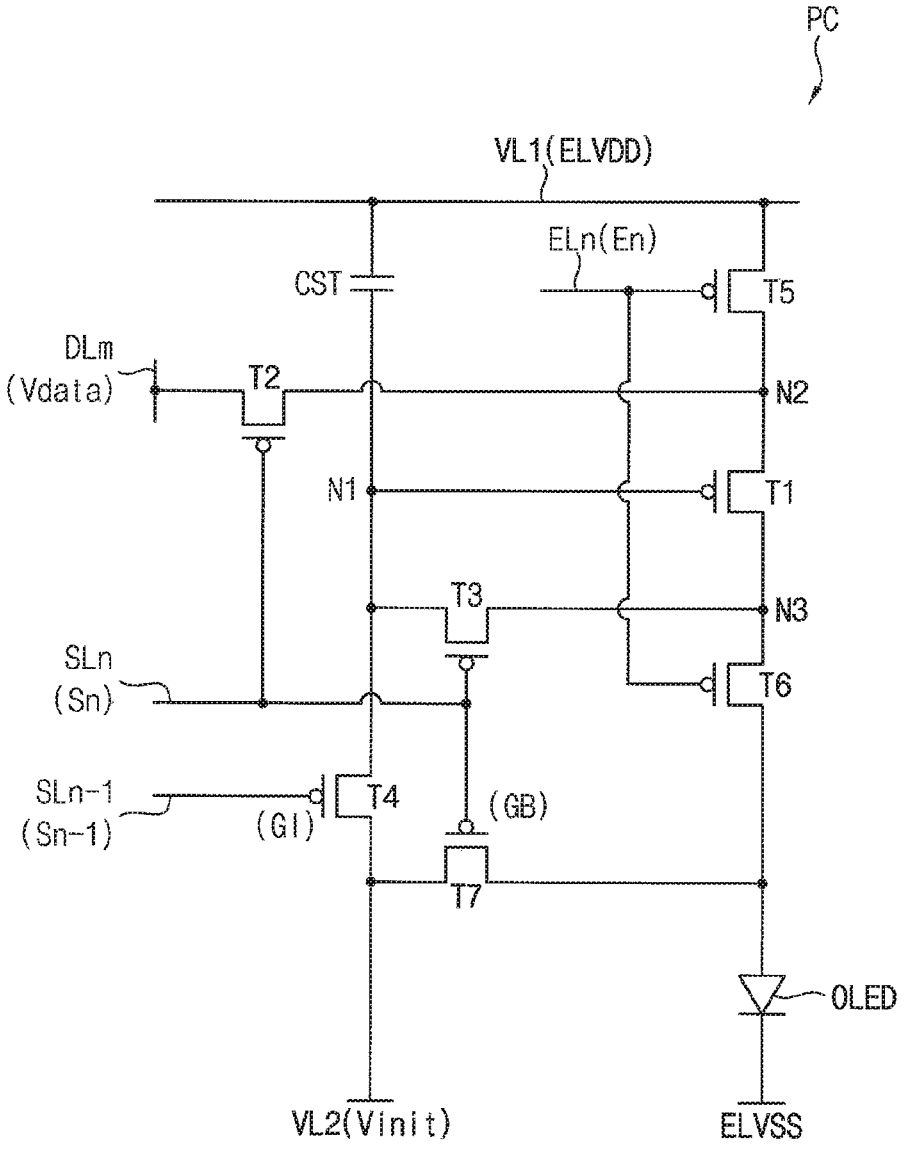
FIG. 2 is a circuit diagram illustrating a pixel circuit according to one exemplary embodiment.
Figure 3:
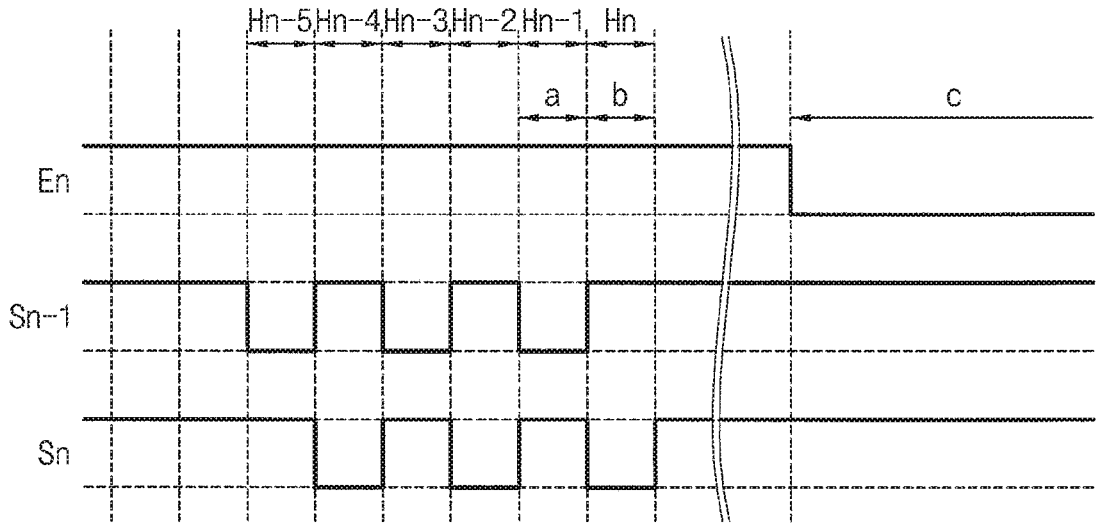
FIG. 3 is a waveform diagram illustrating a driving signal of the pixel circuit according to one exemplary embodiment.

FIG. 2 is a circuit diagram illustrating a pixel circuit according to one exemplary embodiment. FIG. 3 is a waveform diagram illustrating a driving signal of the pixel circuit according to one exemplary embodiment.

Referring to FIGS. 1, 2 and 3, the pixel circuit PC may include a first transistor T1, a capacitor CST, a second transistor T2, a third transistor T3, a fourth transistor T4, a fifth transistor T5, a sixth transistor T6 and a seventh transistor T7.

According to an exemplary embodiment, the transistor is a P-type transistor which is turned on in response to a low voltage applied to a control electrode of the transistor and is turned off in response to a high voltage applied to the control electrode of the transistor. Alternatively, the transistor may be an N-type transistor which is turned on in response to a high voltage applied to a control electrode of the transistor and is turned off in response to a low voltage applied to the control electrode of the transistor.

The first transistor T1 includes a first electrode connected to a first node N1, a second electrode connected to a second node N2 and a third electrode connected to a third node N3.

The capacitor CST includes a first electrode connected to a first voltage line VL1 and a second electrode connected to the first node N1. The first voltage line VL1 receives a high-power source voltage ELVDD.

The second transistor T2 includes a first electrode receiving an n-th scan signal Sn, a second electrode connected to the data line DLm and a third electrode connected to the second node N2. The data line DLm may transfer the data voltage Vdata to the pixel P. The n-th scan signal Sn is provided to the scan driver 130 and the first electrode of the second transistor T2 may be connected to an n-th scan line SLn. The n-th scan signal Sn has a scan ON voltage L (low voltage) for turning on the second transistor T2 and a scan OFF voltage H (high voltage) for turning off the second transistor T2.

According to an exemplary embodiment, the n-th scan signal Sn has the low voltage L in an n-th horizontal period Hn corresponding to the current pixel, an (n−2)-th horizontal period Hn−2 corresponding to a first previous pixel and an (n−4)-th horizontal period Hn−4 corresponding to a second previous pixel.

The third transistor T3 includes a first electrode receiving the n-th scan signal Sn, a second electrode connected to a first node N1 and a third electrode connected to the third node N3. The first electrode of the third transistor T3 may be connected to the n-th scan line SLn.

The fourth transistor T4 includes a first electrode receiving a first gate signal GI, a second electrode connected to the first node N1 and a third electrode connected to the second voltage line VL2. The first gate signal GI may have a delay difference from the n-th scan signal Sn. For example, the first gate signal GI may be an (n−1)-th scan signal Sn−1 provided from the scan driver 130 and to be transferred through an (n−1)-th scan line SLn−1.

According to an exemplary embodiment, the (n−1)-th scan signal Sn−1 has the low voltage L in an (n−1)-th horizontal period Hn−1 and an (n−3)-th horizontal period Hn−3 and an (n−5)-th horizontal period Hn−5 which are the previous horizontal period of the (n−1)-th horizontal period Hn−1.

The fifth transistor T5 includes a first electrode connected to an n-th light-emitting line ELn, a second electrode connected to the first voltage line VL1 and a third electrode connected to the second node N2. The n-th light-emitting line ELn receives an n-th light-emitting control signal En provided from the emission driver 160. The n-th light-emitting control signal En may have a light-emitting ON voltage L (low voltage) for turning on the fifth transistor T5 and a light-emitting OFF voltage H (high voltage) for turning off the fifth transistor T5.

The sixth transistor T6 includes a first electrode connected to the n-th light-emitting line ELn, a second electrode connected to the third node N3, and a third electrode connected to the anode electrode of the organic light emitting diode OLED. The n-th light-emitting line ELn may receive an n-th light-emitting control signal En provided from the emission driver 160.

The seventh transistor T7 includes a first electrode receiving a second gate signal GB, a second electrode connected to the second voltage line VL2 and a third electrode connected to the anode electrode of the organic light emitting diode OLED.

The second gate signal GB may be synchronized with the n-th scan signal Sn and then the first electrode of the seventh transistor T7 is connected to the n-th scan line SLn to receive the n-th scan signal Sn.

Alternatively, not shown, the second gate signal GB may be synchronized with an (n+1)-th scan signal Sn+1 and then, the first electrode of the seventh transistor T7 is connected to an (n+1)-th scan line SLn+1 to receive the (n+1)-th scan signal Sn+1.

A method of driving the pixel circuit PC according to an exemplary embodiment is as follows.

During a first period 'a' of a frame, the fourth transistor T4 is turned on in response to a low voltage of an (n−1)-th scan signal Sn−1 applied to a second scan line SLn−1, and remaining transistors T1, T2, T3, T5, T6 and T7 are turned off. Thus, a previous data voltage charged in the capacitor CST is initialized into the initial voltage Vinit applied to the second voltage line VL2.

During a second period 'b' of a frame, a second transistor T2, a third transistor T3, and a seventh transistor T7 are turned on in response to a low voltage of an n-th scan signal Sn applied to a first scan line SLn, and remaining transistors T1, T4, T5 and T6 are turned off.

Thus, the third transistor T3 is turned on and thus the first transistor T1 is diode-connected by the third transistor T3. The second node N2 receives a data voltage Vdata applied to the data line DLm. The first node N1 receives a difference voltage between the data voltage Vdata of the second node N2 and the threshold voltage Vth of the first transistor T1. The difference voltage between the data voltage Vdata of the second node N2 and the threshold voltage Vth is applied to the first node N1, and thus the threshold voltage of the first transistor T1 may be compensated.

In addition, the capacitor CST charges a voltage corresponding to the data voltage Vdata.

In addition, the seventh transistor T7 is turned on and the initial voltage Vinit is applied to an anode electrode of the organic light emitting diode OLED. Thus, the anode electrode of the organic light emitting diode OLED is initialized into the initial voltage Vinit. Alternatively, not shown, the seventh transistor T7 is turned on in response to (n+1)-th scan signal Sn+1 and then an anode electrode of the organic light emitting diode OLED may be initialized in a period in which the (n+1)-th scan signal Sn+1 has the low voltage.

As shown in FIG. 3 during the second period 'b' of the frame, the threshold voltage of the first transistor T1 may be compensated, the data voltage Vdata may be charged in the capacitor CST, and the anode electrode of the organic light emitting diode OLED may be initialized.

During a third period 'c' of the frame, a low voltage L of an n-th light-emitting control signal En is applied to an n-th light-emitting line ELn, and the fifth and sixth transistors T5 and T6 are turned on. In addition, remaining transistors T1, T2, T3, T4 and T7 are turned off.

Thus, the first transistor T1 is turned on by the data voltage Vdata charged in the capacitor CST, and a driving current corresponding to the data voltage is applied to the organic light emitting diode OLED. Therefore, the organic light emitting diode OLED emits a light corresponding to an image.

Figure 5:
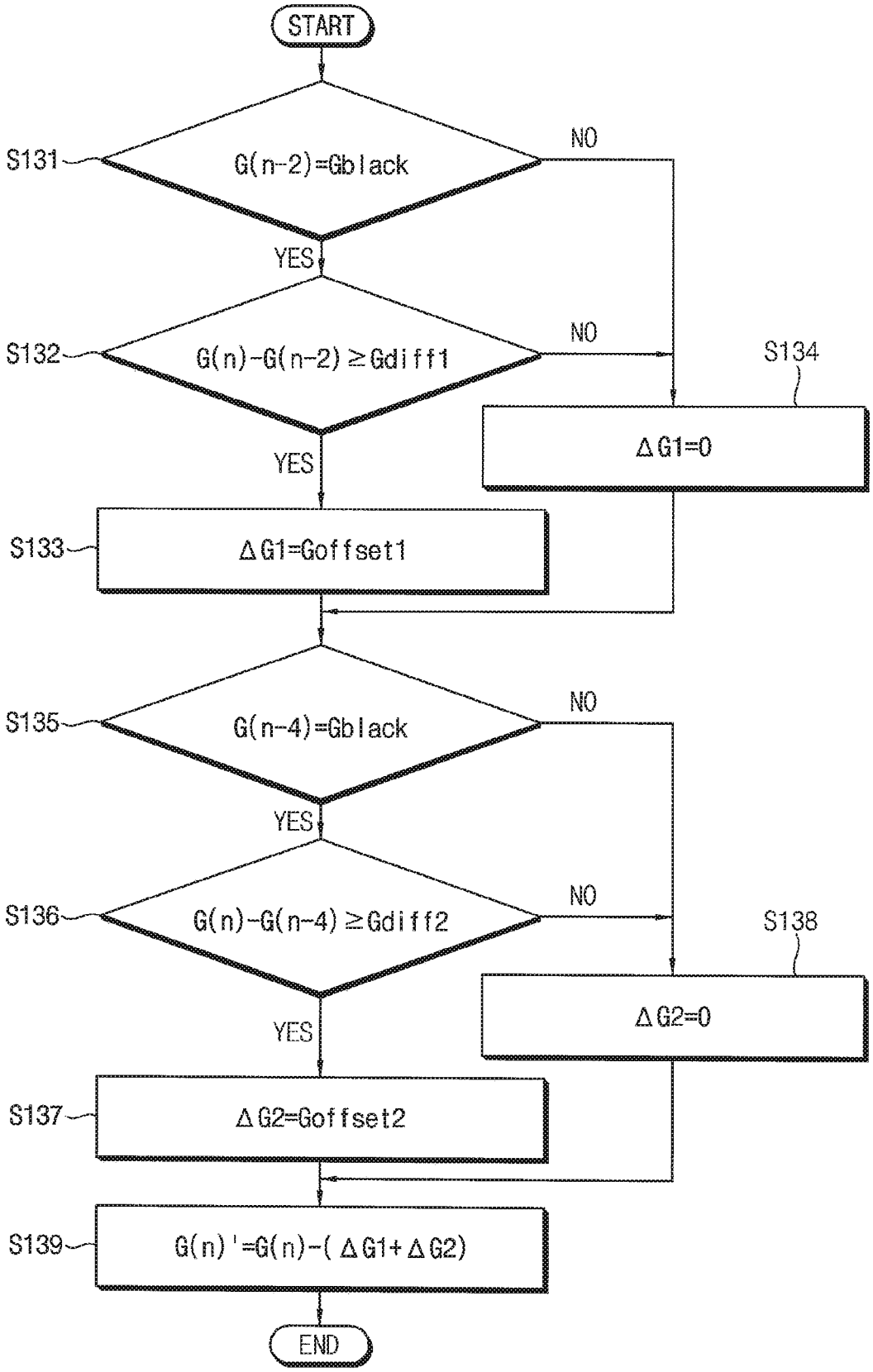
FIG. 5 is a flowchart diagram illustrating a method of correcting a grayscale data according to one exemplary embodiment.

FIG. 5 is a flowchart diagram illustrating a method of correcting a grayscale data according to one exemplary embodiment. FIGS. 6A and 6B are conceptual diagrams illustrating a method of correcting a grayscale data according to one exemplary embodiment.

Figure 4:
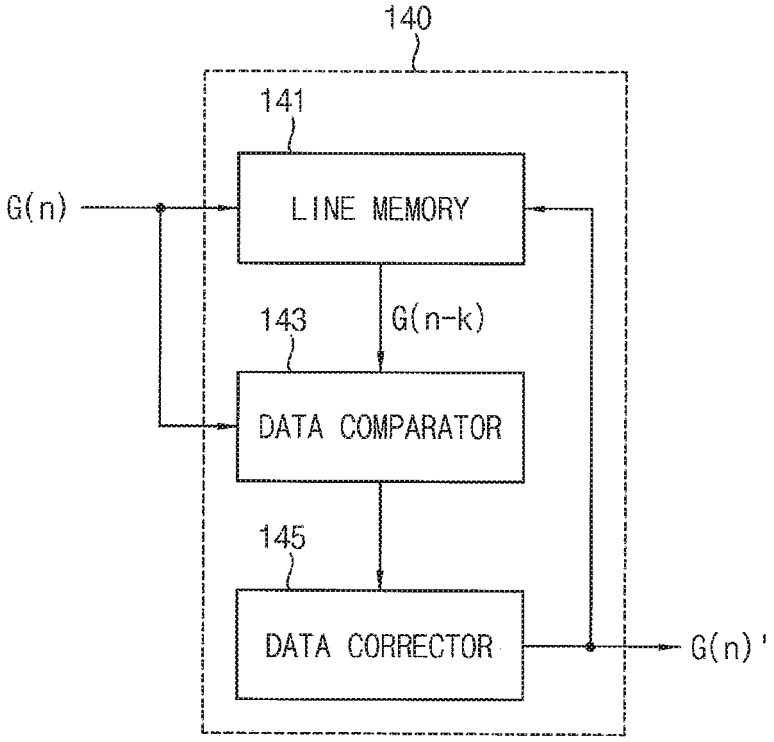
FIG. 4 is a block diagram illustrating a grayscale data processor according to one exemplary embodiment.

Referring to FIGS. 4 and 5, the grayscale data processor 140 may include a line memory 141, a data comparator 143 and a data corrector 145.

The line memory 141 stores grayscale data corresponding to a plurality of pixels in a plurality of pixel rows.

The data comparator 143 compares current grayscale data G(n) corresponding to a current pixel and previous grayscale data G(n−k) of corresponding to a k-th previous pixel in a same pixel column as the current pixel. Where 'k' is an even number that is equal to or than 2, the current pixel is included in an n-th pixel row.

According to an exemplary embodiment, as shown FIG. 3, the n-th scan signal Sn of an MC 3-clk mode has the low voltage in an n-th horizontal period Hn corresponding to a current horizontal period, an (n−2)-th horizontal period Hn−2 corresponding to a first previous horizontal period of the n-th horizontal period Hn and an (n−4)-th horizontal period Hn−4 corresponding to a second previous horizontal period of the n-th horizontal period Hn previous.

The data comparator 143 compares the current grayscale data G(n), first previous grayscale data G(n−2) corresponding to the (n−2)-th horizontal period Hn−2 and second previous grayscale data G(n−4) corresponding to the (n−4)-th horizontal period Hn−4 and determines a correction value for correcting the current grayscale data G(n).

The data comparator 143 may determine the correction value for correcting the current grayscale data G(n) when the current grayscale data G(n), the first previous grayscale data G(n−2) and the second previous grayscale data G(n−4) satisfy a preset condition.

The data comparator 143 determines whether the first previous grayscale data G(n−2) of the current grayscale data G(n) are a black grayscale Gblak (Step S131). The black grayscale Gblak may be predetermined as various data levels according characteristic of the display panel.

The data comparator 143 determines whether the first previous grayscale data G(n−2) are the black grayscale Gblak (Step S131). When the first previous grayscale data G(n−2) are not the black grayscale, the data comparator 143 determines a first correction value ΔG1 of the current grayscale data G(n) with respect to the first previous grayscale data G(n−2) into "0" (Step S134).

However, when the first previous grayscale data G(n−2) are the black grayscale Gblak, the data comparator 143 determines whether a first grayscale difference (G(n)−G(n−2)) between the current grayscale data G(n) and the first previous grayscale data G(n−2) is more than a first preset difference Ddiff1 (Step S132).

When the first grayscale difference (G(n)−G(n−2)) is more than the first preset difference Ddiff1, the data comparator 143 determines the first correction value ΔG1 of the current grayscale data G(n) with respect to the first previous grayscale data G(n−2) into a first offset value Goffset1 (Step S133).

When the first grayscale difference ((G(n)−G(n−2))) is smaller than the first preset difference Ddiff1, the data comparator 143 determines the first correction value ΔG1 of the current grayscale data G(n) with respect to the first previous grayscale data G(n−2) into "0" (Step S134).

Then, the data comparator 143 determines whether the second previous grayscale data G(n−4) with respect to the current grayscale data G(n) are the black grayscale Gblak (Step S135).

When the second previous grayscale data G(n−4) are not the black grayscale Gblack, the data comparator 143 determines the second correction value ΔG2 of the current grayscale data G(n) with respect to the second previous grayscale data G(n−4) into "0" (Step S138).

However, when the second previous grayscale data G(n−4) are the black grayscale Gblak, the data comparator 143 determines whether a second grayscale difference (G(n)−G(n−4)) between the current grayscale data G(n) and the second previous grayscale data G(n−4) is more than a second preset difference Ddiff2 (Step S136). The second preset difference Ddiff2 may be equal to or different from the first preset difference Ddiff1.

When the second grayscale difference (G(n)−G(n−4)) is more than the second preset difference Ddiff2, the data comparator 143 determines a second correction value ΔG2 of the current grayscale data G(n) with respect to the second previous grayscale data G(n−4) into a second offset value Goffset2 (Step S137). The second offset value Goffset2 may be equal to or different from the first offset value Goffset1.

When the second grayscale difference (G(n)−G(n−4)) is smaller than the second preset difference Ddiff2, the data comparator 143 determines a second correction value ΔG2 of the current grayscale data G(n) with respect to the second previous grayscale data G(n−4) into "0" (Step S135).

The data corrector 145 adds the first correction value ΔG1 with respect to the first previous grayscale data G(n−2) to the second correction value ΔG2 with respect to the second previous grayscale data G(n−4) determined from the data comparator 143 and calculates a final correction value (ΔG1+ΔG2) of the current grayscale data G(n).

The data corrector 145 applies the final correction value (ΔG1+ΔG2) to the current grayscale data G(n) and generates correction grayscale data G(n)' of the current grayscale data G(n) (Step S139). The data corrector 145 may store the correction grayscale data G(n)' of the current grayscale data G(n) at the line memory 141. The correction grayscale data G(n)' in the line memory 141 may be used previous grayscale data of a next pixel Pn+2.

Hereinafter, according to an exemplary embodiment, a method of generating the n-th scan signal of the MC 3-clk mode which has a scan ON voltage for driving the n-th scan line in the n-th horizontal period Hn, the (n−4)-th horizontal period Hn−4 and (n−8)-th horizontal period Hn−8, is explained.

FIGS. 6A and 6B are conceptual diagrams illustrating a method of correcting a grayscale data according to one exemplary embodiment.

Referring to FIGS. 5, 6A and 6B, the data comparator 143 determines whether the current grayscale data G(n) are 120 grayscale and the first previous grayscale data G(n−4) are the black grayscale (0 grayscale) (Step S131). The first previous grayscale data G(n−4) are the grayscale data of the pixel correspond to the (n−4)-th horizontal period Hn−4.

When the first previous grayscale data G(n−4) are 0 grayscale, the data comparator 143 determines whether the first grayscale difference (G(n)−G(n−4)) between the current grayscale data G(n) and the first previous grayscale data G(n−4) is the first preset difference Ddiff1 (e.g., 64 grayscale) (Step S132).

The first grayscale difference (G(n)−G(n−4)) is a 120 grayscale and more than a 64 grayscale and thus, the data comparator 143 determines the first correction value ΔG1 of the current grayscale data G(n) with respect to the first previous grayscale data G(n−4) into the first offset value Goffset1, that is "−3" (Step S133).

Then, the data comparator 143 determines whether the second previous grayscale data G(n−8) with respect to the current grayscale data G(n) is 0 grayscale (Step S135). The second previous grayscale data G(n−8) are the grayscale data of the pixel corresponding to an (n−8)-th horizontal period Hn−8.

When the second previous grayscale data G(n−8) are 0 grayscale, the data comparator 143 determines whether the second grayscale difference (G(n)−G(n−8)) between the current grayscale data G(n) and the second previous grayscale data G(n−8) is the second preset difference Ddiff2 that is more than 64 grayscale (Step S136).

The second grayscale difference (G(n)−G(n−8)) is a 120 grayscale and more than 64 grayscale and thus, the data comparator 143 determines the second correction value ΔG2 of the current grayscale data G(n) with respect to the second previous grayscale data G(n−8) into the second offset value Goffset2, that is "−3" (Step S137).

The data corrector 145 adds the first correction value ΔG1=−3 with respect to the first previous grayscale data G(n−2) to the second correction value ΔG2=−3 with respect to the second previous grayscale data G(n−4) determined from the data comparator 143 and calculates the final correction value (ΔG1+ΔG2=−6) of the current grayscale data G(n).

The data corrector 145 applies the final correction value (ΔG1+ΔG2=−6) to the current grayscale data G(n) that are the 120 grayscale and generates correction grayscale data G(n)' of the current grayscale data G(n), that are 114 grayscale (Step S139).

FIGS. 7A and 7B are conceptual diagrams illustrating a method of correcting a grayscale data according to one exemplary embodiment.

Referring to FIGS. 5, 7A and 7B, the data comparator 143 determines whether the current grayscale data G(n) are 120 grayscale and the first previous grayscale data G(n−4) are the black grayscale (0 grayscale) (Step S131). The first previous grayscale data G(n−4) are the grayscale data of the pixel correspond to the (n−4)-th horizontal period Hn−4.

When the first previous grayscale data G(n−4) are 120 grayscale and not 0 grayscale, the data comparator 143 determines the first correction value ΔG1 of the current grayscale data G(n) with respect to the first previous grayscale data G(n−4) into "0" (Step S134).

Then, the data comparator 143 determines whether the second previous grayscale data G(n−8) with respect to the current grayscale data G(n) is 0 grayscale (Step S135). The second previous grayscale data G(n−8) are the grayscale data of the pixel corresponding to an (n−8)-th horizontal period Hn−8.

When the second previous grayscale data G(n−8) are 0 grayscale, the data comparator 143 determines whether the second grayscale difference (G(n)−G(n−8)) between the current grayscale data G(n) and the second previous grayscale data G(n−8) is the second preset difference Ddiff2 that is more than 64 grayscale (Step S136).

The second grayscale difference (G(n)−G(n−8)) is 120 grayscale and more than 64 grayscale and thus, the data comparator 143 determines the second correction value ΔG2 of the current grayscale data G(n) with respect to the second previous grayscale data G(n−8) into the second offset value Goffset2, that is "−3" (Step S137).

The data corrector 145 adds the first correction value ΔG1=0 with respect to the first previous grayscale data G(n−2) to the second correction value ΔG2=−3 with respect to the second previous grayscale data G(n−4) determined from the data comparator 143 and calculates the final correction value (ΔG1+ΔG2=−3) of the current grayscale data G(n).

The data corrector 145 applies the final correction value (ΔG1+ΔG2=−3) to the current grayscale data G(n) that are the 120 grayscale and generates correction grayscale data G(n)' of the current grayscale data G(n) that are 117 grayscale (Step S139).

Figure 8A:
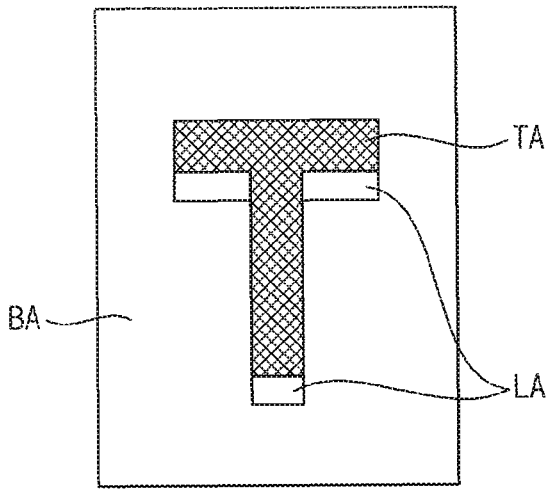
FIGS. 8A and 8B are conceptual diagrams illustrating a display screen according to a comparative embodiment and an exemplary embodiment.
Figure 8B:
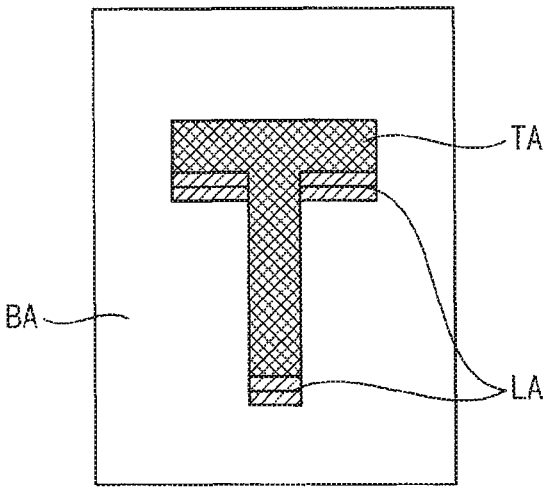

FIGS. 8A and 8B are conceptual diagrams illustrating a display screen according to a comparative embodiment and an exemplary embodiment. FIG. 8A is a conceptual diagram illustrating a display screen including a text ghost according to a comparative embodiment and FIG. 8B is a conceptual diagram illustrating a display screen improved the text ghost according to an exemplary embodiment.

Referring to FIG. 8A, when a display panel displays a black image, a black data voltage of a high voltage level is applied to the pixel circuit including a P-type transistor to lower the luminance sufficiently. When a gate voltage level of the P-type transistor increases, a driving current applied to the organic light emitting diode in the pixel circuit sufficiently decreases. Thus, the organic light emitting diode does not emit the light and then the pixel circuit displays the black grayscale. Particularly, the black data voltage is predetermined to a high level including margin in accordance with the characteristic of transistors and the characteristic of temperature in the use environment of the display device.

When the pixel circuit receives the scan signal of the MC clk mode, the pixel circuit receives a previous data voltage before receiving a current data voltage by the scan signal of the MC clk mode and thus, the on-bias of the pixel circuit is changed by the previous data voltage.

As shown in FIG. 8A, a screen displaying a text includes a text area TA displaying the text, a lower area LA of the text area TA and a background area BA of the text area TA. In comparison with the lower area LA and the background area BA, the text area TA is a previous area of the lower area LA with respect to a column direction. The pixel circuit in the lower area LA receives a black data voltage that is a previous data voltage and thus, a strong on-bias is applied to the pixel circuit in the lower area LA.

However, the background area BA is a previous area of the background area BA with respect to the column direction. The pixel circuit in the background area BA receives a same white data voltage that is a previous data voltage and thus, a weak on-bias is applied to the pixel circuit in the background area BA.

The pixel luminance of the lower area LA is changed by the black data voltage applied to the text area TA and a change in the luminance generates a text ghost in which the luminance increases in the lower area LA.

However, according to an exemplary embodiment, the data voltage of the pixel circuit in the lower area LA which the black data voltage is applied as the previous data voltage, is corrected based on the previous black data voltage.

The data voltage of the pixel circuit in the lower area LA is corrected to a lower voltage as low as a preset offset value based on the previous black data voltage. The corrected data voltage is applied to the pixel circuit in the lower area LA and thus the lower area LA may have a gradual luminance. Therefore, the text ghost in the lower area LA may be eliminated.

Figure 9:
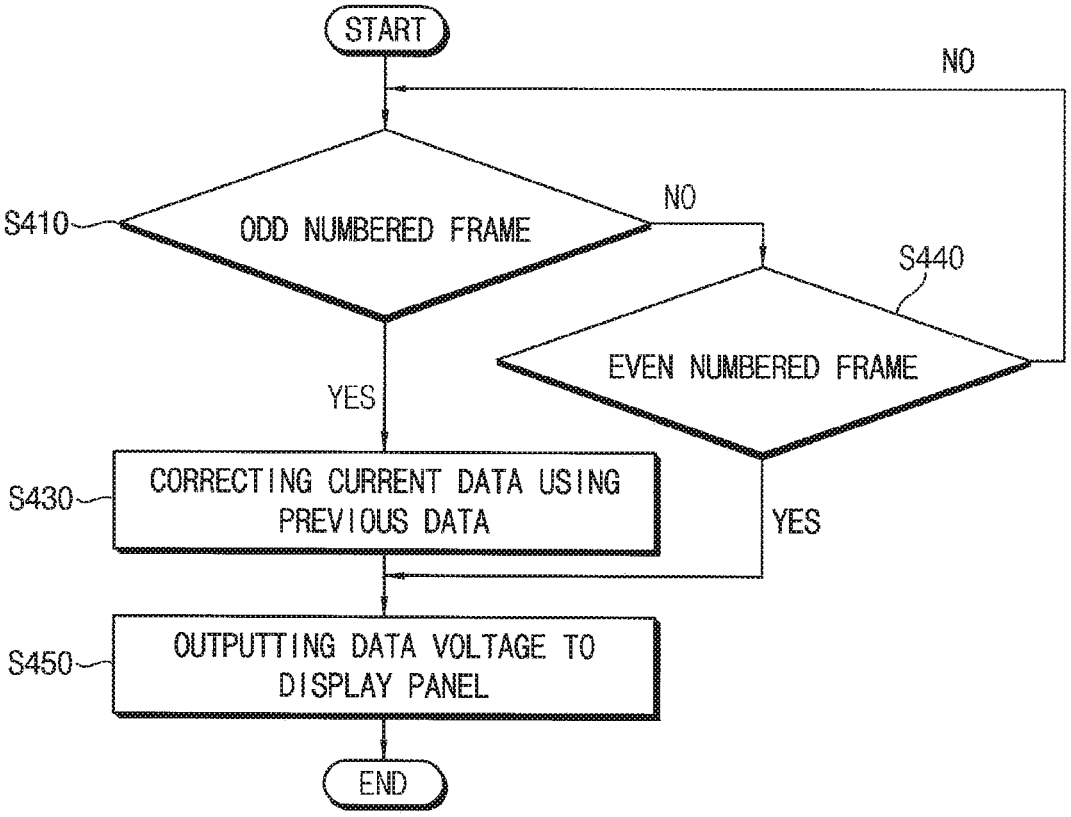
FIG. 9 is a flowchart diagram illustrating a method of driving a display device according to one exemplary embodiment.

FIG. 9 is a flowchart diagram illustrating a method of driving a display device according to one exemplary embodiment.

Referring to FIGS. 1, 5 and 9, the timing controller 120 determines whether an image signal is an image signal corresponding to an odd numbered frame (Step S410).

When the image signal is the image signal of the odd numbered frame, the timing controller 120 controls the grayscale data processor 140 and the grayscale data processor 140 corrects grayscale data of the image signal for the odd numbered frame. The grayscale data processor 140 corrects the grayscale data of the current pixel based on grayscale data of the current pixel and at least one previous pixel in a same pixel column as the current pixel (Step S430). A method of correcting the grayscale data is the same as the method described in the previous exemplary embodiment referring to FIG. 5, and the same detailed explanations are not repeated unless necessary.

The data driver 150 converts the grayscale data DATA for the odd numbered frame provided from the grayscale data processor 140 to a data voltage and outputs the data voltage to the data lines DL1, . . . , DLm, . . . , DLM.

The scan driver 130 and the emission driver 160 drive as described in the previous exemplary embodiment. Thus, the pixel circuit in the display panel 110 may be driven.

However, when the image signal DATA is the image signal of an even numbered frame (Step S440), the timing controller 120 controls the grayscale data processor 140, and the grayscale data processor 140 does not correct grayscale data of the image for the even numbered frame. Thus, the grayscale data processor 140 provides the uncorrected grayscale data for the even numbered frame to the data driver 150.

The data driver 150 converts the grayscale data for the even numbered frame to a data voltage and outputs the data voltage to the data lines DL1, . . . , DLm, . . . , DLM.

The scan driver 130 and the emission driver 160 drive as described in the previous exemplary embodiment. Thus, the pixel circuit in the display panel 110 may be driven.

According to an exemplary embodiment, the display device corrects the image signal for the odd numbered frame according to the MC clk mode, and does not correct the image signal for the even numbered frame according to the MC clk mode. Therefore, image distortion which may be observed by the grayscale correction may be reduced.

Figure 10:
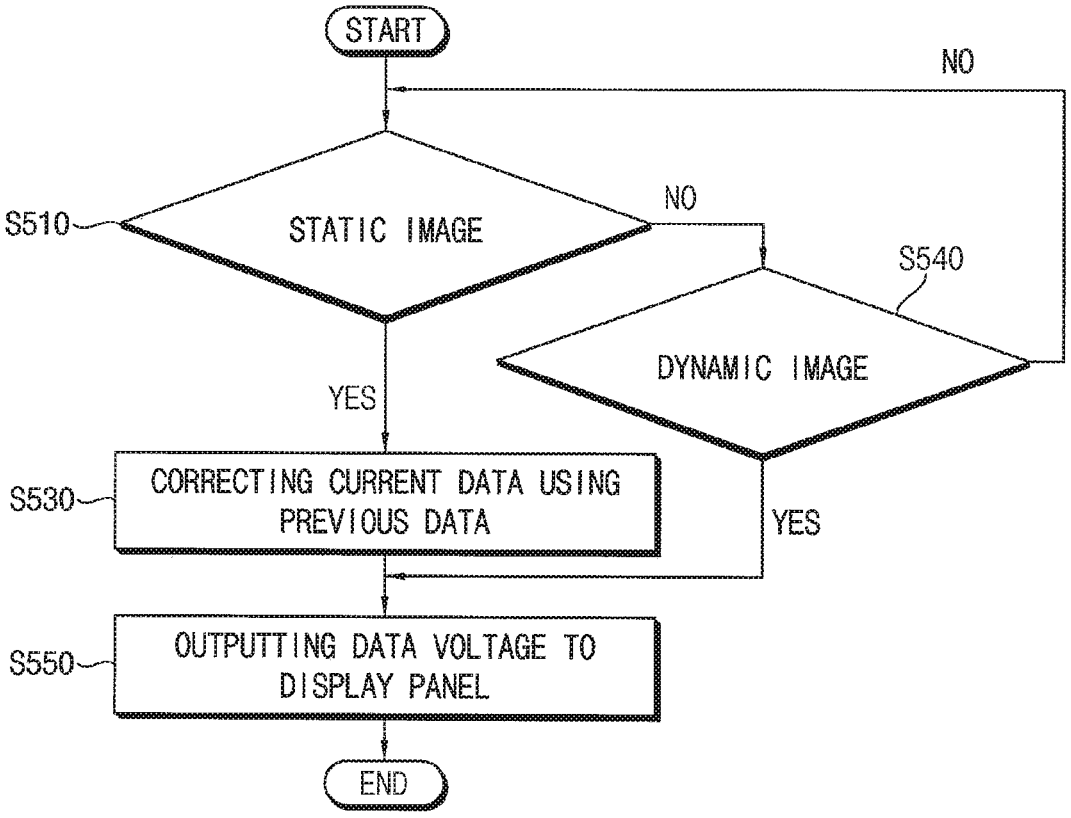
FIG. 10 is a flowchart diagram illustrating a method of driving a display device according to one exemplary embodiment.

FIG. 10 is a flowchart diagram illustrating a method of driving a display device according to one exemplary embodiment.

Referring to FIGS. 1, 5 and 10, the timing controller 120 determines whether an image signal is an image signal corresponding to a static image signal (Step S510).

When the image signal is the static image signal, the timing controller 120 controls the grayscale data processor 140 and the grayscale data processor 140 corrects grayscale data of the image signal for the odd numbered frame. The grayscale data processor 140 corrects the grayscale data of the current pixel based on grayscale data of the current pixel and at least one previous pixel in a same pixel column as the current pixel (Step S530). A method of correcting the grayscale data is the same as the method described in the previous exemplary embodiment referring to FIG. 5, and the same detailed explanations are not repeated unless necessary.

The data driver 150 converts the grayscale data provided from the grayscale data processor 140 to a data voltage and outputs the data voltage to the data lines DL1, . . . , DLm, . . . , DLM.

The scan driver 130 and the emission driver 160 drive as described in the previous exemplary embodiment. Thus, the pixel circuit in the display panel 110 may be driven.

However, when the image signal is a dynamic image signal (Step S540), the timing controller 120 controls the grayscale data processor 140, and the grayscale data processor 140 does not correct grayscale data of the dynamic image signal. Thus, the grayscale data processor 140 provides the uncorrected grayscale data of the dynamic image signal to the data driver 150.

The data driver 150 converts the grayscale data of the dynamic image signal to a data voltage and outputs the data voltage to the data lines DL1, . . . , DLm, . . . , DLM.

The scan driver 130 and the emission driver 160 drive as described in the previous exemplary embodiment. Thus, the pixel circuit in the display panel 110 may be driven According to an exemplary embodiment, the display device corrects the static image signal according to the MC clk mode, and does not correct the dynamic image signal according to the MC clk mode. Therefore, the grayscale data of the static image in which the text ghost is easily observed may be selectively corrected.

In addition, not shown, in an exemplary embodiment, a large offset value for correcting the grayscale value is preset in the static image and a small offset value for correcting the grayscale value is preset in the dynamic image. Thus, the image may adaptively process with respect to the static image and the dynamic image.

According to the exemplary embodiments, in the display device applying the MC clk mode, the grayscale data of the current pixel is corrected based on the previous pixel data of at least one previous pixel in the same pixel column as the current pixel and thus, display defects such as the text ghost may be eliminated.

The present inventive concepts may be applied to a display device and an electronic device having the display device. For example, the present inventive concepts may be applied to a computer monitor, a laptop, a digital camera, a cellular phone, a smart phone, a smart pad, a television, a personal digital assistant (PDA), a portable multimedia player (PMP), a MP3 player, a navigation system, a game console, a video phone, etc.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A display device comprising:

a display panel comprising a pixel which comprises an organic light emitting diode and a plurality of transistors connected to a scan line, a data line and an emission control line and driving the organic light emitting diode;

a scan driver configured to provide a scan signal to the scan line, the scan signal having an ON voltage for turning on a transistor in a plurality of horizontal periods including a current horizontal period and at least one previous horizontal period corresponding to the scan signal;

a grayscale data processor configured to correct current grayscale data of a current pixel corresponding to the current horizontal period to generate correction grayscale data based on previous grayscale data of a previous pixel corresponding to the previous horizontal period, the current pixel included in a same pixel column as the previous pixel; and a data driver configured to convert the correction grayscale data to a data voltage and to provide the data voltage to the data line, wherein, during one frame, an n-th scan signal, where 'n' is a natural number, has a scan ON voltage in an n-th horizontal period and at least one (n−k)-th horizontal period, where 'k' is an even number which is equal to or more than 2.

2. The display device of claim 1, wherein the grayscale data processor comprises:

a line memory configured to store grayscale data of pixels included in a plurality of pixel rows;

a data comparator configured to compare the at least one previous grayscale data with the current grayscale data, to determine at least one correction value and to calculate a final correction value adding the at least one correction value each other; and a data corrector configured to add the final correction value to the current grayscale data to generate the correction grayscale data of the current grayscale data.

3. The display device of claim 2, wherein the pixel comprises a pixel circuit, the pixel circuit comprising:

an organic light emitting diode emitting a light corresponding to a grayscale;

a first transistor comprising a first electrode connected to a first node, a second electrode connected to a second node and a third electrode connected to a third node;

a capacitor comprising a first electrode receiving a first power source voltage and a second electrode connected to the first node;

a second transistor comprising a first electrode connected to an n-th scan signal, a second electrode receiving a data voltage and a third electrode connected to the second node;

a third transistor comprising a first electrode receiving the n-th scan signal, a second electrode connected to the first node and a third electrode connected to the third node; and a sixth transistor comprising a first electrode receiving a light-emitting control signal, a second electrode connected to the third node and a third electrode connected to an anode electrode of the organic light emitting diode.

4. The display device of claim 3, wherein the pixel circuit further comprises a fourth transistor comprising a first electrode receiving a first gate signal, a second electrode connected to the first node and a third electrode receiving a second power source voltage.

5. The display device of claim 4, wherein the first gate signal is an (n−1)-th scan signal.

6. The display device of claim 4, wherein the pixel circuit further comprises:

a fifth transistor comprising a first electrode receiving the light-emitting control signal, a second electrode receiving the first power source voltage and a third electrode connected to the second node; and a seventh transistor comprising a first electrode receiving the n-th scan signal, a second electrode receiving the second power source voltage and a third electrode connected to an anode electrode of the organic light emitting diode.

7. The display device of claim 2, wherein when the previous grayscale data are black grayscale data and a grayscale difference between the previous grayscale data and the current grayscale data is more than a reference difference, the data comparator is configured to determine an offset value as the at least one correction value.

8. The display device of claim 2, wherein when first previous grayscale data are black grayscale data and a grayscale difference between the first previous grayscale data and the current grayscale data is more than a first reference difference, the data comparator is configured to determine a first offset value as a first correction value, and when second previous grayscale data are black grayscale data and a grayscale difference between the second previous grayscale data and the current grayscale data is more than a second reference difference, the data comparator is configured to determine a second offset value as a second correction value and to add the first correction value to the second correction value to calculate the final correction value.

9. A method of driving a display device which comprises a pixel which comprises an organic light emitting diode and a plurality of transistors connected to a scan line, a data line and an emission control line and driving the organic light emitting diode, the method comprising:

providing a scan signal to the scan line, the scan signal having an ON voltage for turning on a transistor in a plurality of horizontal periods including a current horizontal period and at least one previous horizontal period corresponding to the scan signal;

correcting current grayscale data of a current pixel corresponding to the current horizontal period to generate correction grayscale data based on previous grayscale data of a previous pixel corresponding to the previous horizontal period, the current pixel included in a same pixel column as the previous pixel; and converting the correction grayscale data to a data voltage to provide to the data line, wherein, during one frame, an n-th scan signal, where 'n' is a natural number, has a scan ON voltage in an n-th horizontal period and at least one (n−k)-th horizontal period, where 'k' is an even number which is equal to or more than 2.

10. The method of claim 9, further comprising:

storing grayscale data of pixels included in a plurality of pixel rows;

comparing the at least one previous grayscale data with the current grayscale data, to determine at least one correction value and to calculate a final correction value adding the at least one correction value each other; and adding the final correction value to the current grayscale data to generate the correction grayscale data of the current grayscale data.

11. The method of claim 10, further comprising:

determining an offset value as the at least one correction value, when the previous grayscale data are black grayscale data and a grayscale difference between the previous grayscale data and the current grayscale data is more than a reference difference.

12. The method of claim 11, further comprising:

determining a first offset value as a first correction value, when first previous grayscale data are black grayscale data and a grayscale difference between the first previous grayscale data and the current grayscale data is more than a first reference difference;

determining a second offset value as a second correction value, when second previous grayscale data are black grayscale data and a grayscale difference between the second previous grayscale data and the current grayscale data is more than a second reference difference; and adding the first correction value to the second correction value to calculate the final correction value.

13. The method of claim 10, wherein the pixel comprises a pixel circuit, the pixel circuit comprising:

an organic light emitting diode emitting a light corresponding to a grayscale;

a first transistor comprising a first electrode connected to a first node, a second electrode connected to a second node and a third electrode connected to a third node;

a capacitor comprising a first electrode receiving a first power source voltage and a second electrode connected to the first node;

a second transistor comprising a first electrode connected to an n-th scan signal, a second electrode receiving a data voltage and a third electrode connected to the second node;

a third transistor comprising a first electrode receiving the n-th scan signal, a second electrode connected to the first node and a third electrode connected to the third node; and a sixth transistor comprising a first electrode receiving a light-emitting control signal, a second electrode connected to the third node and a third electrode connected to an anode electrode of the organic light emitting diode.

14. The method of claim 13, wherein the pixel circuit further comprises a fourth transistor comprising a first electrode receiving a first gate signal, a second electrode connected to the first node and a third electrode receiving a second power source voltage.

15. A method of driving a display device which comprises a pixel which comprises an organic light emitting diode and a plurality of transistors connected to a scan line, a data line and an emission control line and driving the organic light emitting diode, the method comprising:

determining whether an image signal is an image signal of an odd numbered frame or an even numbered frame;

providing a scan signal to the scan line, the scan signal having an ON voltage for turning on a transistor in a plurality of horizontal periods including a current horizontal period and at least one previous horizontal period corresponding to the scan signal;

correcting current grayscale data of a current pixel corresponding to the current horizontal period to generate correction grayscale data based on previous grayscale data of a previous pixel corresponding to the previous horizontal period, the current pixel included in a same pixel column as the previous pixel when the image signal is the image signal of the odd numbered frame; and converting the correction grayscale data of the odd numbered frame to a data voltage to provide to the data line.

16. The method of claim 15, further comprising:

when the image signal is the image signal of the odd numbered frame, providing a scan signal to the scan line, the scan signal having an ON voltage for turning on a transistor in a plurality of horizontal periods including a current horizontal period and at least one previous horizontal period corresponding to the scan signal; and converting the correction grayscale data of the even numbered frame to a data voltage to provide to the data line.

17. A method of driving a display device which comprises a pixel which comprises an organic light emitting diode and a plurality of transistors connected to a scan line, a data line and an emission control line and driving the organic light emitting diode, the method comprising:

determining whether an image signal is a static image signal or a dynamic image signal;

providing a scan signal to the scan line, the scan signal having an ON voltage for turning on a transistor in a plurality of horizontal periods including a current horizontal period and at least one previous horizontal period corresponding to the scan signal;

correcting current grayscale data of a current pixel corresponding to the current horizontal period to generate correction grayscale data based on previous grayscale data of a previous pixel corresponding to the previous horizontal period, the current pixel included in a same pixel column as the previous pixel when the image signal is the static image signal; and converting the correction grayscale data of the static image signal to a data voltage to provide to the data line.

18. The method of claim 17, further comprising:

when the image signal is dynamic image signal, providing a scan signal to the scan line, the scan signal having an ON voltage for turning on a transistor in a plurality of horizontal periods including a current horizontal period and at least one previous horizontal period corresponding to the scan signal; and converting the correction grayscale data of the dynamic image signal to a data voltage to provide to the data line.

* * * * *